United States Patent [19]

Margraf et al.

[11] 4,199,084

[45] Apr. 22, 1980

[54] FOUNDRY LADLE SUPPORT DEVICE HAVING GUIDES FOR LADLE PLACEMENT

[75] Inventors: Karl H. Margraf, Langenfeld; Herbert Hansen, Düsseldorf, both of Fed. Rep. of Germany

[73] Assignee: Sack GmbH, Düsseldorf, Fed. Rep. of Germany

[21] Appl. No.: 953,599

[22] Filed: Oct. 23, 1978

[30] Foreign Application Priority Data

Oct. 4, 1977 [DE] Fed. Rep. of Germany ..... 2744670

[51] Int. Cl.[2] ..... B22D 41/00

[52] U.S. Cl. ..... 222/591; 222/168

[58] Field of Search ..... 164/437, 438; 222/160, 222/166, 168, 590, 591, 604, 606, 607

[56] References Cited

U.S. PATENT DOCUMENTS 3,817,318 6/1974 Greenberger et al. ..... 222/607 X

FOREIGN PATENT DOCUMENTS 1076904 3/1957 Fed. Rep. of Germany ..... 222/166

2033011 1/1972 Fed. Rep. of Germany ..... 164/438

2309293 11/1976 France ..... 164/438

*Primary Examiner*—David A. Scherbel

*Attorney, Agent, or Firm*—John J. Dennemeyer

[57] ABSTRACT

Supporting apparatus for a foundry ladle has a vertical support member on which are rotatably mounted a number of horizontal support members. A ladle carrier is provided at the outer end of each horizontal support member. The carrier comprises spaced parallel carrier arms with respective parallelogram linkages mounting the arms on the support member so as to project beyond the end thereof in a vertically movable manner. Lateral brackets extend from the support member in flanking relationship with the carrier arms for guiding a foundry ladle into a position in which it is ready to be received by the carrier.

4 Claims, 3 Drawing Figures

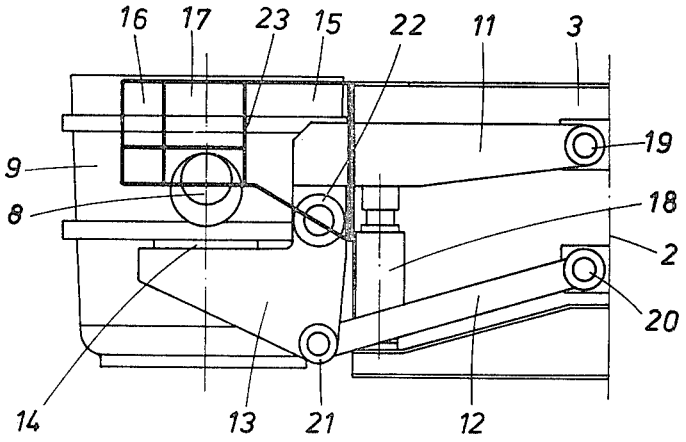
Fig. 2
Fig. 3
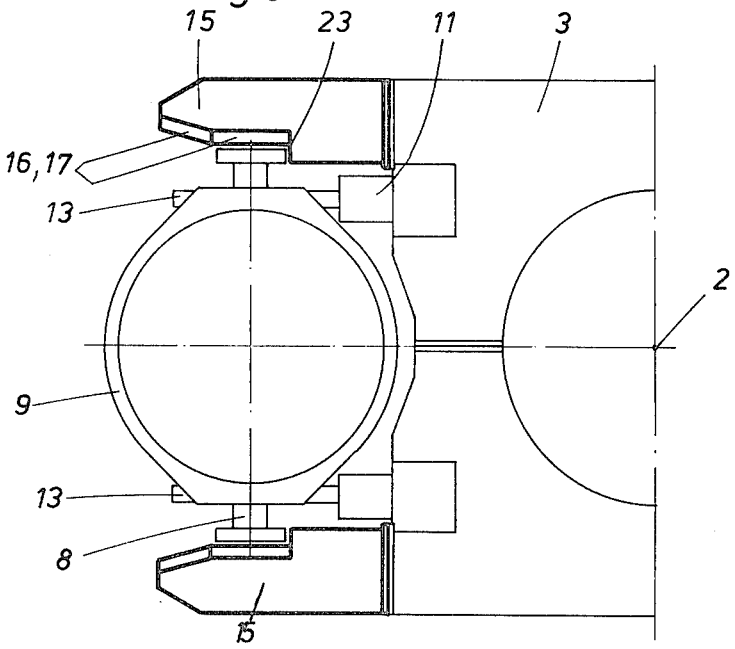

FOUNDRY LADLE SUPPORT DEVICE HAVING GUIDES FOR LADLE PLACEMENT

The invention relates to a foundry ladle supporting apparatus, a so-called rotary ladle turret, consisting of supporting arms able to rotate about a stationary vertical pillar, for the transportation of foundry ladles to intermediate containers located above the chill mould of a continuous casting installation, in which case guide rods forming a parallelogram are provided, projecting beyond both sides of each supporting arm, which guide rods respectively support a plate with opposed supports, on which a foundry ladle can be placed.

In continuous casting, it is known to transport liquid steel poured into foundry ladles by a travelling crane to the pouring platform of a continuous casting installation. Whilst they are conveyed, the foundry ladles are suspended by their supporting journals in a suitable crane harness or on runners in the cross beams of cranes. Furthermore, it is known to transfer the full foundry ladles to a supporting arm of a rotary ladle turret, which due to a swinging movement then moves the supporting arm with the full prepared ladle from the delivery position into the casting position by way of an intermediate container located above the chill mould. If the rotary ladle turret is constructed from two supporting arms located opposite each other and able to be swung together, as the full ladle arrives, the empty foundry ladle is simultaneously swung out of the casting position into the delivery or removal position.

The supporting arms of a rotary ladle turret may thus be constructed so that they are provided at their ends with recesses open on one side (German Patent Specification No. 1 220 562), whereby the ends of the supporting arms are in the shape of a fork, which comprise supports for the supporting journals of foundry ladles. According to its application, a rotary ladle turret may also be constructed so that a continuous cross beam forming the supporting arms is able to pivot about a pivot point. However, a supporting arm of this type does not have a fork-like recess for the foundry ladle on its end face, but in place of the latter is provided with guide rods forming a parallelogram, attached on both sides to the side faces of the supporting arms and able to be adjusted by hydraulic cylinders. The guide rods project beyond the end face of the supporting arm and are connected at their ends by way of pivots to plates which comprise supports. The foundry ladles are deposited in these supports which are in alignment in the two plates.

In the case of the afore-described supporting arm, it has proved a great disadvantage that upon transferring a foundry ladle from the foundry crane to the supports of the plates supported by the guide rods in the form of a parallelogram, the vertical or horizontal impact forces occurring at the time of introducing the ladle, are transmitted very vigorously to the pivots or joints of the guide rods. These high stresses result in rapid wear of the pivots and related operating interruptions on the rotary ladle turret.

It is the object of the invention to further develop a foundry ladle support device with guide rods in the form of a parallelogram on the supporting arms to the effect that the pivot points of the guide rods forming a parallelogram are unaffected by the vertical or horizontal forces occurring when introducing a foundry ladle and greater operating reliability of the rotary ladle turret is thus ensured.

According to the invention, the object is fulfilled due to the fact that brackets are fixed to the supporting arm in parallel and adjacent the lateral guide rods forming a parallelogram and the plates supported by the latter, as an extension of one supporting arm and that the brackets contain vertical and horizontal introduction chamfers for the supporting journals of a foundry ladle, whereby according to one advantageous embodiment of the invention, the brackets consist of a box-like welded construction.

In contrast to the known supporting arm with guide rods forming a parallelogram, in the supporting device according to the invention, the foundry ladles or their supporting journals are firstly introduced into the introduction chamfers of the brackets. The considerable vertical or horizontal impact forces inevitably occurring when introducing a foundry ladle by means of the crane are thus absorbed by the brackets or supporting arm itself and upon continuing the introduction, centering and stabilization of the foundry ladle in the introduction chambers takes place so that the foundry ladle guided exclusively on the supporting arm can be introduced and then lowered in a controlled manner into its end position. The pivots or joints of the guide rods forming a parallelogram thus receive only the forces which occur at the time of direct positioning of the foundry ladle in the supports in the plates, caused by the lowering speed of the crane.

One embodiment of a foundry ladle support device according to the invention is illustrated in the drawings and in particular:

FIG. 2 is a side view of the support device according to the invention, in which only the end of one supporting arm of a symmetrical rotary turret is shown in cross section and FIG. 3 is a plan view of FIG. 2.

Figure 1:
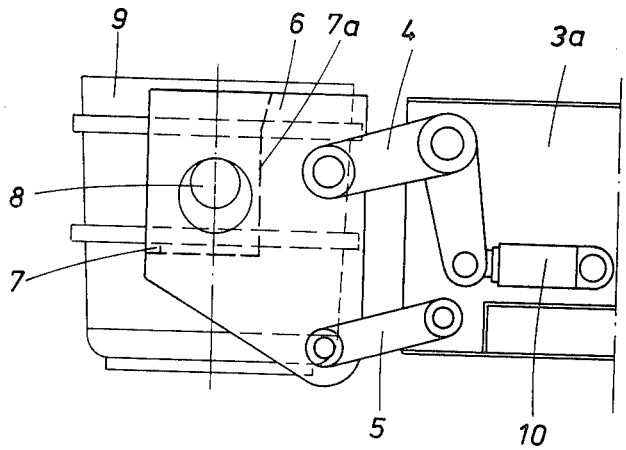
Fig. 1 PRIOR ART
FIG. 1 is a side view of a supporting arm of conventional construction.

The rotary ladle turret which is not shown in detail comprises for example a pillar extending vertically upwards from a foundation, which pillar supports at its upper end an elongated cross beam projecting on both sides of the pillar by the same length. The cross beam is able to pivot in the horizontal plane by means of a rotating track about the vertical central axis 2 of the pillar, in which case the cross beam forms the two supporting arms of the rotary ladle turret, of which only one supporting arm is illustrated in the drawings on account of the symmetrical arrangement of a rotary ladle turret or the foundry ladle support device.

In a known foundry ladle support device according to FIG. 1, guide rods 4, 5 are attached parallel to each other to the support arm 3*a* on each side. The guide rods 4, 5 project beyond the end or end face of the supporting arm 3*a* and support plates 6. The two opposed plates 6 are provided with supports 7 for receiving the supporting journals 8 of a foundry ladle 9. Cylinders 10 likewise provided on the supporting arm 3*a*, act on the guide rods 4 for raising and lowering the plates 6 and thus a suspended foundry ladle 9, whereby due to the parallel co-ordination of the guide rod 5, a quasirectilinear lifting movement of the plates 6 and of the foundry ladle 9 is possible. Moreover, the location or provision of guide rods on or in the supporting arm may naturally be modified as desired, provided that the method of operation of the guide rods forming a parallelogram is not impaired. If a foundry ladle is introduced into a supporting arm constructed in this way and seated on the support 7, not only are the contact forces and the weight of the ladle fully transmitted to the pivots or joints of the levers, but above all the pivots must absorb the forces and the main impact stresses occurring when the foundry ladle is introduced and in particular when the ladle comes to bear against the abutment edges *7a* limiting the horizontal introduction movement of the ladle.

As can be seen from FIGS. 2 and 3, in the supporting arm 3 according to the invention, the guide rods 11, 12 are connected at one end in a free space inside the supporting arm 3 and project beyond the end face of the supporting arm, where they are connected at the other end to the plates 13. In contrast to the plates of the known support device, the plates 13 are substantially lower, so that with their supports 14, they are located below the brackets or guide means 15 fixed to the arm and arranged on both sides in parallel adjacent the guide rods as an extension of the supporting arm. However, depending on the arrangement of the supporting journals 8 of a foundry ladle, it is quite possible to extend the plates further in an upwards direction and thus likewise to locate the supports in the region of the brackets. The brackets 15 consist of a box-like welded construction and contain horizontal and vertical introduction chamfers 16, 17 with abutment edges 23 for the horizontal limitation of the introduction movement of a foundry ladle. It will be apparent from the foregoing and from the drawing that brackets 15 are separate from and mechanically independent of the guide rods or carrier arms 11, 12.

After a foundry ladle 9 has been introduced by a foundry crane with the supporting journals 8 either laterally or from above into the introduction chamfers 16, 17 of the brackets 15, in which case all the forces occurring at the time of the introduction are transmitted to the brackets or to the supporting arm itself, due to the introduction chamfers, the ladle undergoes centering, due to which controlled stabilised guidance of the foundry ladle is possible. The foundry ladle then abuts in a horizontal direction against the abutment edges 23 limiting the introductory travel of the ladle. The impact caused by the abutment and actually occurring as the main stress is likewise not absorbed by the pivots. The pivots 19, 20, 21, 22 themselves are in this case only subjected to stress when the foundry ladle 9 is finally lowered onto the supports 14 of the plates 13. In this position, the foundry ladle may then be handled by actuating the cylinders 18 acting on the guide rods 11.

We claim:

1. Foundry ladle supporting apparatus comprising a vertical support member, a plurality of horizontal support members mounted for rotation on the vertical support member, a ladle carrier at the outer end of each horizontal support member, said carrier comprising spaced, parallel carrier arms and respective parallelogram linkages mounting the arms on the support member so as to project beyond the end thereof in a vertically movable manner, and lateral guide means affixed to and extending from at least one support member in flanking relationship with the carrier arms and separate from and mechanically independent of the carrier arms for guiding a foundry ladle into a position in which it is ready to be received by the carrier, whereby shocks created by introduction of the ladle into the ladle carrier bypass the ladle carrier and are borne by the guide means and horizontal support.

2. Apparatus as claimed in claim 1, wherein each lateral guide means has vertical and horizontal abutment surfaces for the trunnions of a foundry ladle.

3. Apparatus as claimed in claim 1 or 2, wherein each lateral guide means is a welded box construction.

4. Apparatus as claimed in claim 1 wherein said abutment surfaces are chamfered.

* * * * *